US010190845B1

(12) United States Patent
Olson

(10) Patent No.: US 10,190,845 B1
(45) Date of Patent: Jan. 29, 2019

(54) PIN PUSHER FOR FIREARMS

(71) Applicant: Bradley S. Olson, Saint Cloud, MN (US)

(72) Inventor: Bradley S. Olson, Saint Cloud, MN (US)

( * ) Notice: Subject to any disclaimer, the term of this patent is extended or adjusted under 35 U.S.C. 154(b) by 0 days.

(21) Appl. No.: 15/908,652

(22) Filed: Feb. 28, 2018

Related U.S. Application Data

(60) Provisional application No. 62/484,767, filed on Apr. 12, 2017.

(51) Int. Cl.
*F41C 27/00* (2006.01)
*B25B 27/02* (2006.01)

(52) U.S. Cl.
CPC ..... *F41C 27/00* (2013.01); *B25B 27/02* (2013.01)

(58) Field of Classification Search
CPC ..... B25G 1/107
USPC ..... 42/90, 108; 81/177.3, 44; 294/25; 401/8
See application file for complete search history.

(56) References Cited

U.S. PATENT DOCUMENTS 1,160,522 A * 11/1915 Morris ..... D05B 91/04 2/21
2,440,854 A * 5/1948 Frank ..... B25B 15/02 81/177.3
4,700,500 A 10/1987 Slappey, Jr.
4,837,963 A 6/1989 Slappey, Jr.
6,173,519 B1 1/2001 Garrett
6,904,634 B2 6/2005 Smith
6,913,406 B1 * 7/2005 Nocerino ..... B43K 23/012 401/7
8,635,799 B2 * 1/2014 Azhocar ..... F41A 17/38 42/108
8,850,738 B2 10/2014 Silver
9,328,983 B2 5/2016 Wilkinson
2005/0120746 A1 * 6/2005 Winston ..... A44C 5/08 63/38
2007/0157665 A1 * 7/2007 Lai ..... A44C 17/00 63/26
2008/0190006 A1 8/2008 Jenkins

* cited by examiner

*Primary Examiner* — Reginald S Tillman, Jr.
(74) *Attorney, Agent, or Firm* — Albert W. Watkins

(57) ABSTRACT

A pin pusher for firearms has a resilient generally annular split ring body adapted to encompass and resiliently compress about a periphery of at least one human phalange. At least one wing is provided at a first terminal end of the split ring, and a yoke is provided at a second terminal end of the split ring. A pin punch is affixed on a first end with, supported by, and extends radially from the finger ring. The pin punch is adapted to contact and transfer force to and thereby move a removable firearm pin relative to a firearm. A threaded removable punch tip terminates the pin punch distal to the finger ring and is adapted to engage with the removable firearm pin. A mirror is removably coupled to at least one of the finger ring and pin punch adjacent to a junction between the finger ring and pin punch.

18 Claims, 3 Drawing Sheets

PIN PUSHER FOR FIREARMS

CROSS REFERENCE TO RELATED APPLICATIONS

The present application claims the benefit of U.S. provisional patent application 62/484,767 filed Apr. 12, 2017 of like title and inventorship, the teachings and entire contents which are incorporated herein by reference.

BACKGROUND OF THE INVENTION

1. Field of the Invention

The present invention pertains generally to firearms, and more particularly to an implement or tool that facilitates the insertion and removal of firearm pins during assembly or disassembly of firearms.

2. Description of the Related Art

Many firearms are assembled using a variety of pins that are pressed into position to hold various parts in proper position or alignment. Exemplary pins may include, but are not limited to, hammer pins, mainspring housing retainer pins, magazine catch pins, finishing pins, and various other retaining pins. While many individuals will use a hammer and punch to remove these pins during disassembly, and again to replace these pins during reassembly, the hammer must be held in one hand and the punch in the other. This means that the individual is not able to manipulate or steady the firearm without setting down one or the other of the tools. Likewise, a separate firearm vise or holder is required to secure the firearm while the pins are extracted or inserted. Furthermore, the punch and hammer may inadvertently jump about, which can cause aesthetic and even functional harm to the firearm. While non-marring punches may substantially reduce the likelihood of harm to the firearm such punches also tend to be quite slippery, fabricated from plastics that tend to slide about on a smooth metal surface. As a result, while these plastic tools are safer to use, they are also harder to set in the right position and hold them while hammering.

Recognizing many of the limitations of the hammer and punch, artisans have designed a number of different tools specifically to assist with the removal and replacement of various firearm pins. Exemplary of these tools, the teachings and contents which are incorporated herein by reference, include U.S. Pat. No. 4,700,500 by Slappey, entitled "Field stripping key punch"; U.S. Pat. No. 4,837,963 by Slappey, entitled "Field stripping key punch for firearm trigger assemblies"; U.S. Pat. No. 6,173,519 by Garrett, entitled "Tool for installing/removing magazine catch"; U.S. Pat. No. 6,904,634 by Smith, entitled "Multipurpose 1911 pistol servicing tool"; U.S. Pat. No. 8,850,738 by Silver, entitled "Combination safety round and multi-tool"; U.S. Pat. No. 9,328,983 by Wilkinson, entitled "Special tool device for easy disassembly and reassembly for cleaning an automatic pistol such as a ruger"; and U.S. published patent application 2008/0190006 by Jenkins, entitled "Pin punch tool for firearms". These patents and published application each illustrate the removal of various firearm pins using beneficial tools.

In addition to the foregoing patents, Webster's New Universal Unabridged Dictionary, Second Edition copyright 1983, is incorporated herein by reference in entirety for the definitions of words and terms used herein.

While these patents and published patent applications each offer significant benefit over the prior art hammer and punch, they nevertheless require a person to still dedicate at least one hand to the manipulation of the tool. Furthermore, and like the hammer and punch, if an individual needs to use their second hand, such as during the removal of the mainspring pin, they cannot use both hands and still manipulate the tool.

As may be apparent, in spite of the advancements and substantial research and development that has been conducted, there still remains a need for an improved apparatus for removing and replacing firearm pins.

SUMMARY OF THE INVENTION

In a first manifestation, the invention is a pin pusher for firearms. A finger ring has a resilient generally annular body adapted to encompass and resiliently compress about a periphery of at least one human phalange. A pin punch is affixed on a first end with, supported by, and protrudes from the finger ring. The pin punch is adapted to contact and transfer force to a removable firearm pin and thereby move the removable firearm pin relative to a firearm.

In a second manifestation, the invention is, in combination, a firearm and a pin pusher for firearms. The firearm has a handle, a barrel, a firing chamber, a bore within at least one of the handle, barrel, and firing chamber, and a pin operatively received within and removable from the bore. The pin pusher for firearms has a finger ring having a resilient generally annular body adapted to encompass and resiliently compress about a periphery of at least one human phalange, and a pin punch affixed with, supported by, and extending from the finger ring. The pin punch is adapted to contact and transfer force to the removable firearm pin and thereby move the removable firearm pin relative to the firearm.

In a third manifestation, the invention is a pin pusher for firearms. A finger ring has a resilient generally annular split ring body adapted to encompass and resiliently compress about a periphery of at least one human phalange. At least one wing is provided at a first terminal end of the split ring, and a yoke is provided at a second terminal end of the split ring. A pin punch is affixed on a first end with, supported by, and extends radially from the finger ring. The pin punch is adapted to contact and transfer force to a removable firearm pin and thereby move the removable firearm pin relative to a firearm. A threaded removable punch tip terminates the pin punch at a second end distal to the first end and is adapted to engage with the removable firearm pin. A mirror is adjacent to a junction between the finger ring and pin punch. A removable coupling engages the mirror with at least one of the finger ring and pin punch.

OBJECTS OF THE INVENTION

Exemplary embodiments of the present invention solve inadequacies of the prior art by providing a finger ring that supports a pin punch and preferably a mirror. The finger ring secures the pin punch to a person's finger, while the person retains movement and use of the finger tip, adjacent fingers, and other hand, thereby permitting the person to manipulate the firearm almost as though they were not holding a pin punch at all.

The present invention and the preferred and alternative embodiments have been developed with a number of objectives in mind. While not all of these objectives are found in every embodiment, these objectives nevertheless provide a sense of the general intent and the many possible benefits that are available from embodiments of the present invention.

A first object of the invention is to provide an improved apparatus for removing and replacing firearm pins. A second object of the invention is to enable a person to manipulate or steady a firearm while removing or replacing firearm pins, without having to set down either the firearm or the tool used to assist with the removal or replacement of the firearms. Another object of the present invention is to enable the person to use both hands in the handling and manipulation of the firearm and firearm components, while simultaneously manipulating the tool to facilitate the removal and replacement of firearm pins. A further object of the invention is to provide a tool which provides enhanced viewing of the placement of the pin pusher, even when the pin pusher is on the back side of the firearm. Yet another object of the present invention is to provide a tool that may be used safely, without fear of aesthetic or functional harm to the firearm. An additional object of the invention is to provide a tool which may either be adapted for a particular need or be repaired through the ready manual replacement of components.

BRIEF DESCRIPTION OF THE DRAWINGS

The foregoing and other objects, advantages, and novel features of the present invention can be understood and appreciated by reference to the following detailed description of the invention, taken in conjunction with the accompanying drawings, in which.

DESCRIPTION OF THE PREFERRED EMBODIMENT

Figure 1:
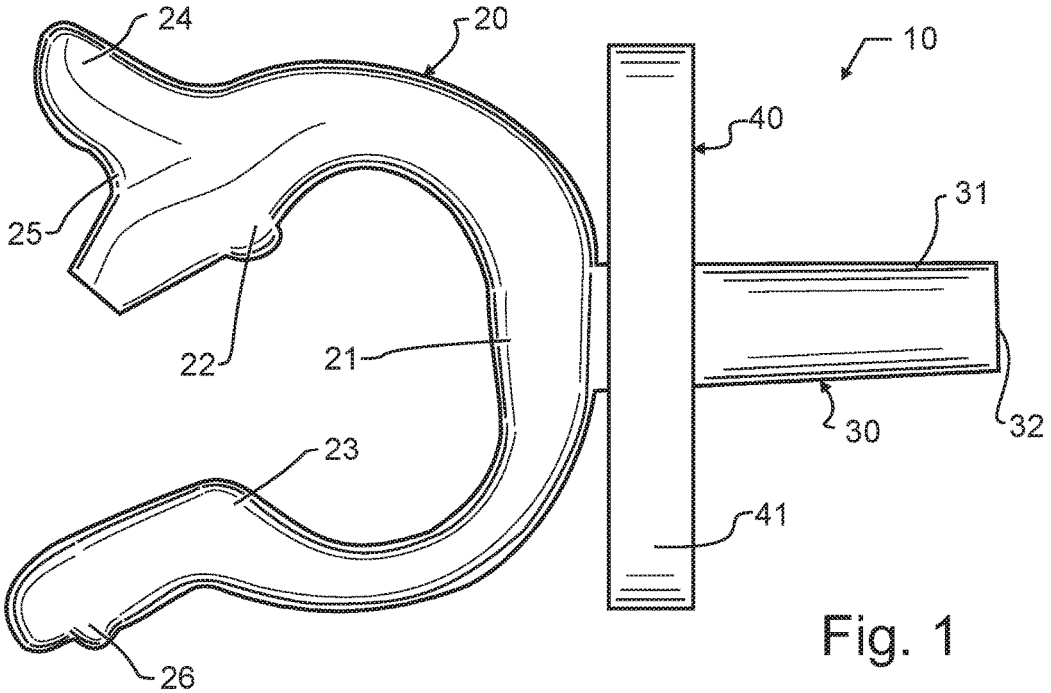
FIG. 1 illustrates a preferred embodiment pin pusher for firearms designed in accord with the teachings of the present invention from a top plan view.
Figure 2:
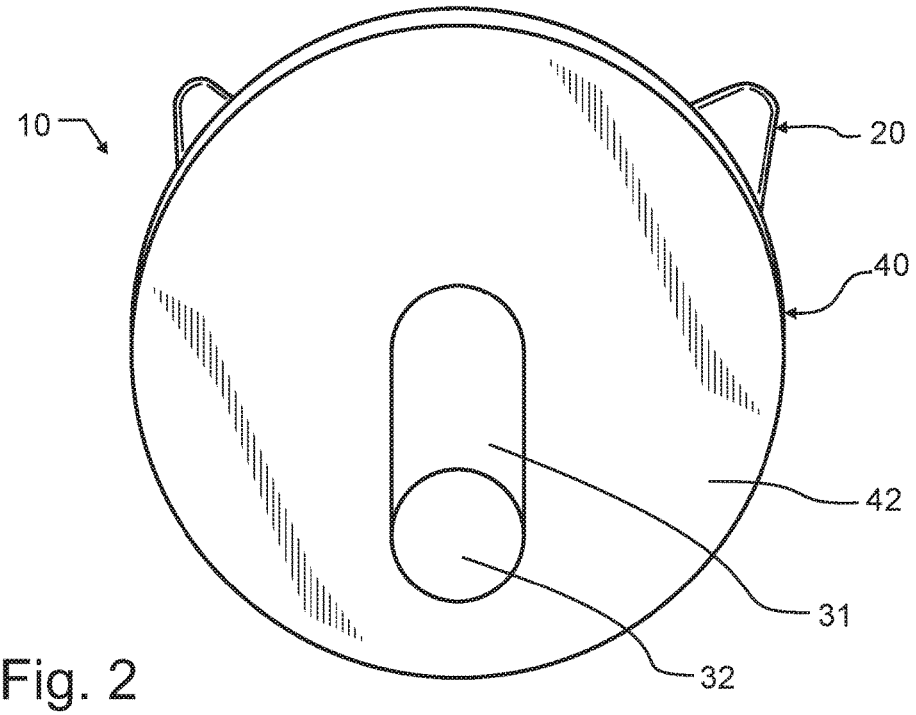
FIG. 2 illustrates the preferred embodiment pin pusher for firearms of FIG. 1 from a generally right side and slightly projected view.
Figure 3:
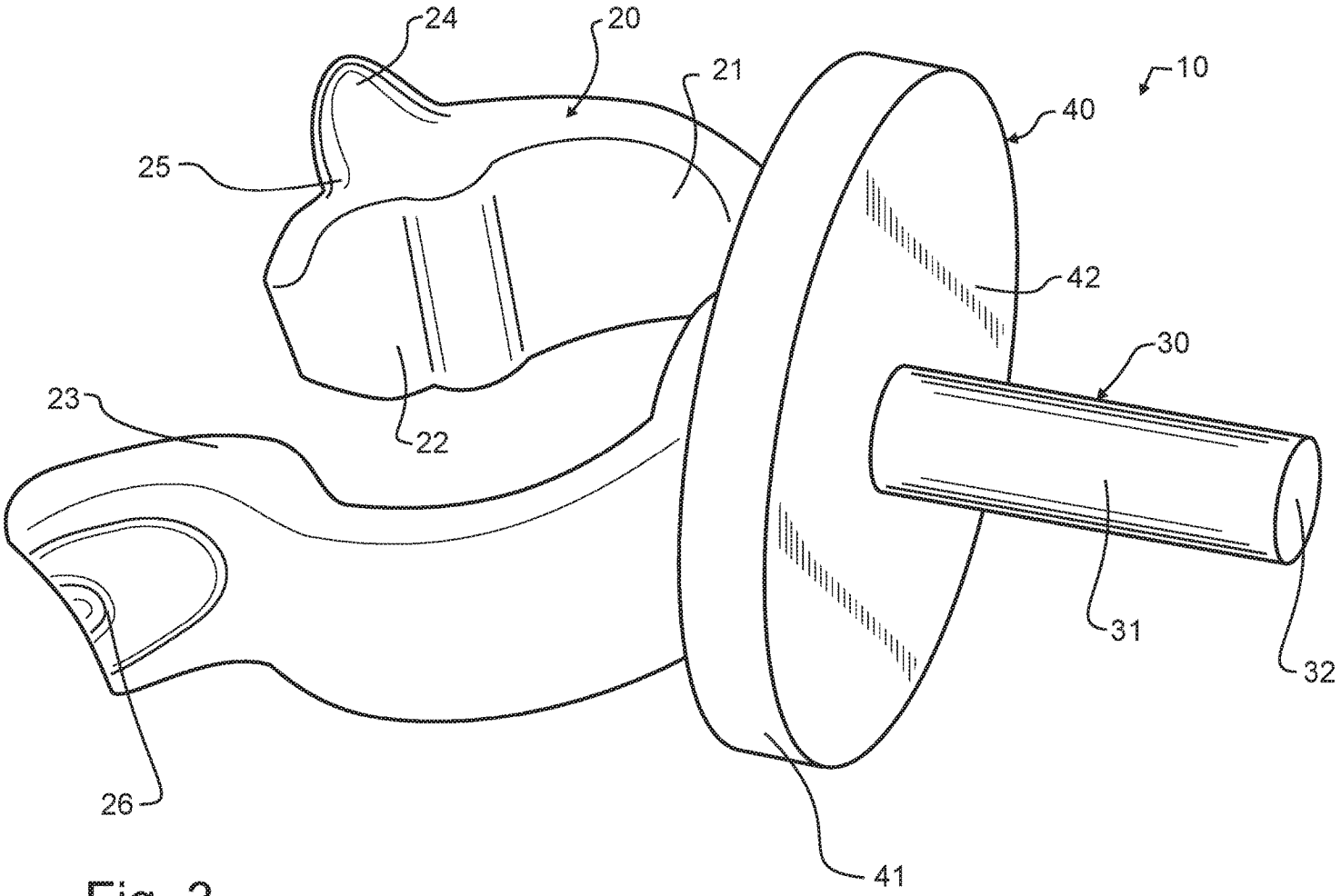
FIG. 3 illustrates the preferred embodiment pin pusher for firearms of FIG. 1 from a generally front and slightly projected view.

Manifested in the preferred and alternative embodiments, the present invention provides a pin pusher tool that is configured to fit around a person's phalanges, and is adapted to be pushed by the person's phalange(s) into a pin and thereby drive the pin from or into a mating hole. In a preferred embodiment of the invention illustrated in FIGS. 1-3, pin pusher for firearms 10 is comprised of a finger ring 20, pin punch 30, and a mirror 40. Finger ring 20 is configured to fit around any one, or if so configured more than one, of a person's phalanges, including those of the fingers and thumbs. Stable hand attachment ensures finger ring 20 and pin punch 30 will stay in stable position relative to the hand even while the hand is being used to manipulate the firing assembly or to hold the firearm. When so attached, preferred embodiment pin pusher for firearms 10 is always available, and ready for use.

Finger ring 20 includes a c-shaped body 21 that is preferably fabricated from a resilient and yet durable material. By using a resilient material, c-shaped body 21 may expand or contract to better accommodate the differing sizes of fingers and thumbs, both among different individuals and also between different phalanges within the same hand. Nevertheless, the forces that will be applied to c-shaped body 21 during use can be significant, particularly when preferred embodiment pin pusher for firearms 10 is misused. As a result, a material sufficiently durable to withstand such forces without failure is also preferred.

While a c-shape is preferred, it will be understood that in some cases it may be desirable for body 21 to wrap around more than one phalange or finger, in which case different geometries may be used. For exemplary and non-limiting illustration, body 21 may be shaped to wrap around two or more adjacent or even non-adjacent fingers simultaneously. While a flat strip formed into a C-ring as illustrated is preferred, other suitable configurations are also incorporated, whether for a single phalange or for multiple phalanges, including for exemplary and non-limiting purposes a glove or finger cot, "brass knuckles" grip, wings, or other suitable geometry.

While there are a myriad of materials suitable for the fabrication of c-shaped body 21, for exemplary purposes only and not solely limiting the present invention thereto one suitable material is a stainless steel. The steel may for exemplary and non-limiting purpose be fabricated from a strip resembling a ribbon prior to shaping into the illustrated c-shape. Alternatively, the steel may be formed or cast, or fabricated from a tube or the like, or any other suitable technique may be used. The steel has a length that approximately defines the c-shaped body 21 circumference wrapping around the outer diameter of a phalange. This length is substantially greater than the c-shaped body 21 width, which approximately defines the length along a phalange that finger ring 20 will extend. The width is in turn substantially greater than thickness, which is the difference in radius between the inside diameter of c-shaped body 21 and the outside diameter. The small thickness relative to the large length provides desired resilience to accommodate phalanges of different diameters, while sufficient width ensures sufficient strength and good securement to the phalange(s) without fear of cutting off circulation or otherwise causing discomfort.

While stainless steel represents one suitable material, as already noted herein above, a myriad of other materials exist that may be used in the fabrication. For exemplary and non-limiting purposes, carbon steel may be used. In such case, a polymer paint, powder coating, dip coating, or other type of exterior treatment may be applied to reduce the likelihood of undesirable corrosion. Alternatively, other non-corroding materials may be used, including not only various metals or metal alloys, but also ceramics, suitable plastics, and composites or laminates. The materials may optionally include various additives or components such as fillers, fibers, or strands, or even different discrete layers, to increase strength, weather and ultraviolet resistance, or provide better feel, cushion, or resilience.

C-shaped body 21 terminates at a first ring body termination 22 and a second ring body termination 23. Extending from each of these terminations 22, 23 are optional but preferred wings 24, 26 that in combination with c-shaped body 21 resemble the geometry of the Greek letter omega. Wings 24, 26 are adapted to lightly engage with fingers adjacent to the one that c-shaped body 21 encompasses. This engagement enables a person to control the orientation of pin punch 30 by gentle movements of the adjacent fingers.

For example, if a person slips c-shaped body 21 about their ring finger, with wing 26 adjacent the pinky finger and wing 24 adjacent the middle finger, then motion tending to draw the pinky finger tip into the palm will also cause the pinky to press against wing 26. This pressure will urge c-shaped body 21 to rotate about the ring finger, changing the orientation of pin punch 30 relative to the person's palm. Likewise, slight movement of the middle finger tip into the palm will cause pin punch 30 to rotate in the opposite direction. As may be apparent then, wings 24, 26 offer increased control over the position of pin punch 30, without requiring a person to reposition their entire hand.

Yoke 25 is also optionally but preferably be provided. Yoke 25 provides a convenient location for a person's thumb to engage with preferred embodiment pin pusher for firearms 10. Through yoke, 25, the thumb may also be used to adjust the orientation of pin punch 30, and may also or alternatively be used to apply pressure or force.

Pin punch 30 is affixed with, supported by, and extends from finger ring 20. While not essential to the present invention, pin punch 30 also extends radially from finger ring 20. As noted herein above, finger ring 20 may preferably be rotated about a phalange to redirect pin punch 30. Radial alignment makes the alignment somewhat more intuitive, while maintaining a relatively compact size for preferred embodiment pin pusher for firearms 10. Compact size is greatly preferred, so that a person may wear preferred embodiment pin pusher for firearms 10 while still grasping the firearm with both hands, if so desired.

Pin punch 30 has a generally cylindrical punch body 31 that terminates distally to finger ring 20 at punch tip 32. Punch tip 32 may be provided with any desired geometry, including but not limited to the traditional flat truncated tips and also the conical tips that are both very commonly found on punches. In some instances, punch tip 32 may alternatively comprise a more hemispherical surface, which will present a surface less likely to scratch any of the firearm components. However, such a surface may also be slightly more difficult to use in the removal and reinstallation of pins, including being slightly more prone to slipping out of alignment with a pin. Likewise, punch body 31 is preferably generally cylindrical, which ensures that it will fit into the largest range of holes to push out pins. However, a slight conical taper may be provided, if so desired or required for a particular application. Further, rather than being cylindrical, punch body 31 may also optionally have one or more facets or flat surfaces formed thereon, if so desired. For exemplary purposes, a hex geometry resembling that of an Allen wrench is contemplated, though not preferred, again owing to the undesirable edges between facets that can concentrate forces that could potentially harm the firearm.

Materials for fabrication of the pin punch 30 are also not critical, though polished stainless steel is preferred, since the firing assembly may spring back onto the pin pusher, and softer materials such as various plastics may undesirably be damaged. In the case of harder core material, a softer coating such as a vinyl dip, powder coat or the like may be preferred, to also protect the firearm from scratches or dents.

As described herein above, preferred embodiment pin pusher for firearms 10 will most preferably permit a person servicing a firearm to use both hands to manipulate the various components. In such case, the person may not have good line of sight to see that pin punch 30 is accurately aligned with a selected pin or pin hole. In such instances, a mirror 40 may be highly beneficial.

Mirror 40 preferably encompasses pin punch 30, and may be flat, gently convex, or even incorporate more complex geometries. Including mirror 40 allows a person to view punch tip 32 from a wider range of angles. Mirror substrate 41 is either intrinsically reflective, or otherwise coated or treated to provide a reflector surface 42 as is well known in the art of reflective surfaces. For exemplary purposes then, a person may hold a pistol in one hand, move the firing assembly forward with the other hand, and still view the position of punch tip 32 relative to the pin when the ring is worn on the hand sliding the firing assembly forward.

Various embodiments of apparatus designed in accord with the present invention have been illustrated in the various figures. The embodiments are distinguished by the hundreds digit, and various components within each embodiment designated by the ones and tens digits. However, many of the components are alike or similar between embodiments, so numbering of the ones and tens digits have been maintained wherever possible, such that identical, like or similar functions may more readily be identified between the embodiments. If not otherwise expressed, those skilled in the art will readily recognize the similarities and understand that in many cases like numbered ones and tens digit components may be substituted from one embodiment to another in accord with the present teachings, except where such substitution would otherwise destroy operation of the embodiment. Consequently, those skilled in the art will readily determine the function and operation of many of the components illustrated herein without unnecessary additional description.

Figure 4:
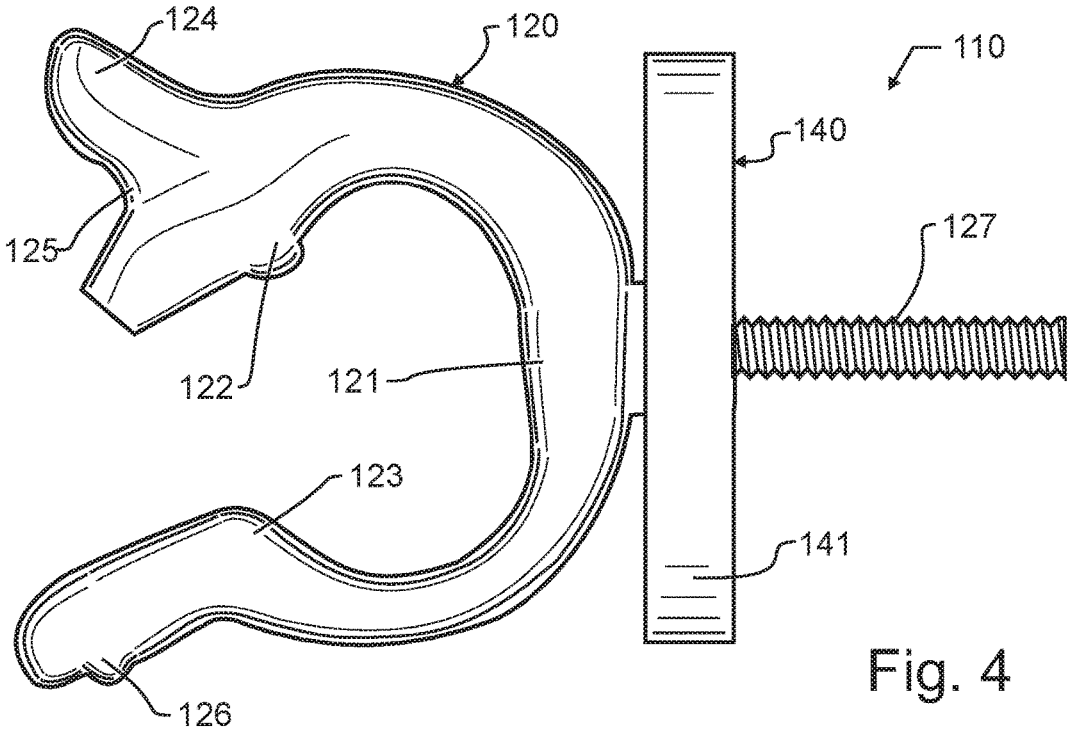
FIG. 4 illustrates a first alternative embodiment pin pusher for firearms designed in accord with the teachings of the present invention from a top plan view.
Figure 5:
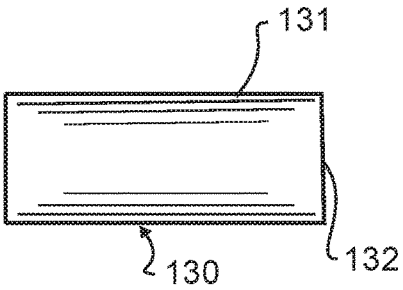
FIG. 5 illustrates a first alternative embodiment flat tip configured for use in the first alternative embodiment pin pusher for firearms of FIG. 4 from a top plan view.

FIG. 4 illustrates a first alternative embodiment pin pusher for firearms 110. In this first alternative embodiment, a threaded rod 127 extends radially from c-shaped body 121. Mirror 140 has a central threaded hole that is cooperative with threaded rod 127 to permit mirror 140 to be spun onto the threading into the ultimate position illustrated in FIG. 4. This also permits mirror 140 to be removed for cleaning or replacement as desired, or simply removed when not needed.

Figure 6:
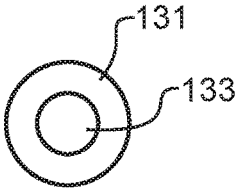
FIG. 6 illustrates the first alternative embodiment flat tip of FIG. 5 from a left side view.

Most preferably, generally cylindrical punch body 131 will have an internally threaded partial bore 133, visible in FIG. 6, that extends from the face opposite punch tip 132 near but not completely to punch tip 132. This permits pin punch 130 to be threaded onto threaded rod 127 and removed therefrom at will. Nevertheless, when punch tip 132 is in place, threaded rod 127 will not come into direct contact with the firearm or firearm pins. Instead, punch tip 132 will cushion and ensure that there is no risk of marring or damage.

Figure 7:
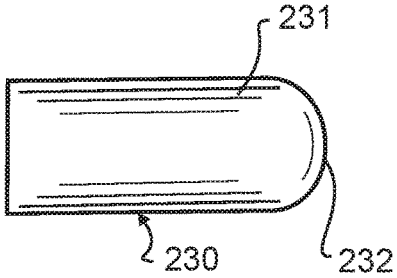
FIG. 7 illustrates a second alternative embodiment round tip configured for use in the first alternative embodiment pin pusher for firearms of FIG. 4 from a top plan view.

FIG. 7 illustrates a second alternative embodiment round tip pin punch 230 configured for use in a manner very similar to first alternative embodiment pin punch 130. An internally threaded partial bore will be provided of like geometry to that of internally threaded partial bore 133 visible in FIG. 6. However, punch tip 232 is preferably dome-shaped, in contrast to the flat surface of punch tip 132. Dome-shaped punch tip 232 is preferable for use on countersunk pins, while flat punch tip 132 is preferable for use on protruding pins. Owing to the internally threaded partial bores such as 133 illustrated in FIG. 6, these punch tips 132, 232 may be easily manually substituted for each other, or replaced due to damage, to select a different material or composition, or for other reasons at will. A person will simply unthread one from threaded rod 127, and thread the other punch tip on.

While the foregoing details what is felt to be the preferred embodiment of the invention, no material limitations to the scope of the claimed invention are intended. Further, features and design alternatives that would be obvious to one of ordinary skill in the art are considered to be incorporated herein. The scope of the invention is set forth and particularly described in the claims herein below.

I claim:

1. A pin pusher for firearms, comprising:

a finger ring having a resilient generally annular body adapted to encompass and resiliently compress about a periphery of at least one human phalange;

a pin punch affixed on a first end with, supported by, and protruding from said finger ring, said pin punch adapted to contact and transfer force to a removable firearm pin and thereby move said removable firearm pin relative to a firearm; and a mirror adjacent to a junction between said finger ring and said pin punch.

2. The pin pusher for firearms of claim 1, wherein said mirror further comprises a removable coupling engaging said mirror with at least one of said finger ring and said pin punch.

3. The pin pusher for firearms of claim 1, wherein said pin punch extends radially from said finger ring.

4. The pin pusher for firearms of claim 3, wherein said pin punch further comprises a punch tip terminating said pin punch at a second end distal to said first end and adapted to engage with said removable firearm pin.

5. The pin pusher for firearms of claim 4, wherein said pin punch further comprises a threaded removable tip.

6. The pin pusher for firearms of claim 1, wherein said resilient generally annular body further comprises a split ring.

7. The pin pusher for firearms of claim 6, wherein said split ring further comprises at least one wing at a first terminal end of said split ring.

8. The pin pusher for firearms of claim 7, further comprising a yoke at a second terminal end of said split ring.

9. In combination, a firearm and a pin pusher for firearms, said firearm having:

a handle;

a barrel;

a firing chamber;

a bore within at least one of said handle, barrel, and firing chamber; and a pin operatively received within and removable from said bore;

said pin pusher for firearms comprising:

a finger ring having a resilient generally annular body adapted to encompass and resiliently compress about a periphery of at least one human phalange; and a pin punch affixed with, supported by, and extending from said finger ring, said pin punch adapted to contact and transfer force to said removable firearm pin and thereby move said removable firearm pin relative to said firearm; and a mirror adjacent to a junction between said finger ring and said pin punch.

10. The combination, a firearm and a pin pusher for firearms of claim 9, wherein said mirror further comprises a removable coupling engaging said mirror with at least one of said finger ring and said pin punch.

11. The combination, a firearm and a pin pusher for firearms of claim 9, wherein said pin punch extends radially from said finger ring.

12. The combination, a firearm and a pin pusher for firearms of claim 11, wherein said pin punch further comprises a punch tip terminating said pin punch at an end distal to said finger ring and adapted to engage with said removable firearm pin.

13. The combination, a firearm and a pin pusher for firearms of claim 12, wherein said pin punch further comprises a threaded removable tip.

14. The combination, a firearm and a pin pusher for firearms of claim 9, wherein said resilient generally annular body further comprises a split ring.

15. The combination, a firearm and a pin pusher for firearms of claim 14, wherein said split ring further comprises at least one wing at a first terminal end of said split ring.

16. The combination, a firearm and a pin pusher for firearms of claim 15, wherein said split ring further comprises at least one wing at a first terminal end of said split ring.

17. The combination, a firearm and a pin pusher for firearms of claim 16, further comprising a yoke at a second terminal end of said split ring.

18. A pin pusher for firearms, comprising:

a finger ring having a resilient generally annular split ring body adapted to encompass and resiliently compress about a periphery of at least one human phalange;

at least one wing at a first terminal end of said split ring;

a yoke at a second terminal end of said split ring;

a pin punch affixed on a first end with, supported by, and extending radially from said finger ring, said pin punch adapted to contact and transfer force to a removable firearm pin and thereby move said removable firearm pin relative to a firearm;

a threaded removable punch tip terminating said pin punch at a second end distal to said first end and adapted to engage with said removable firearm pin;

a mirror adjacent to a junction between said finger ring and said pin punch; and a removable coupling engaging said mirror with at least one of said finger ring and said pin punch.

* * * * *